United States Patent [19]

Nordlie

[11] 4,143,739

[45] Mar. 13, 1979

[54] CONCENTRIC PASS-TYPE MUFFLER CONSTRUCTION

[75] Inventor: Kenneth D. Nordlie, Madison, Wis.

[73] Assignee: Nelson Industries, Inc., Stoughton, Wis.

[21] Appl. No.: 795,005

[22] Filed: May 9, 1977

[51] Int. Cl.[2] ..... F01N 1/08

[52] U.S. Cl. ..... 181/265; 181/272

[58] Field of Search ..... 181/231, 266, 268, 269, 181/272–275, 282, 255, 265, 264, 273, 281

[56] References Cited

U.S. PATENT DOCUMENTS

| | | | |
|---|---|---|---|
| 2,788,078 | 4/1957 | Reindl | 181/255 |
| 3,361,227 | 1/1968 | Kaari | 181/265 |
| 3,480,105 | 11/1969 | Burris | 181/255 |

*Primary Examiner*—L. T. Hix
*Assistant Examiner*—Benjamin R. Fuller
*Attorney, Agent, or Firm*—Andrus, Sceales, Starke & Sawall

[57] ABSTRACT

An improved concentric pass-type muffler construction. The muffler includes an outer generally cylindrical casing enclosed by a pair of end heads, and an inlet tube, connected to the exhaust pipe of an engine, is mounted axially on one head, while an outlet tube is mounted on the opposite head. Located centrally within the casing is an inner body having a central closure or baffle and the inlet tube communicates with the upstream end of the inner body, while the outlet tube communicates with the downstream end of the body. The upstream end of the inner body is provided with an oval configuration and the major diameter of the upstream end is secured to the inner surface of the cylindrical casing. The downstream end of the inner body is also provided with an oval configuration, with the major diameter being displaced 90° from the major diameter of the upstream end of the body, and is secured to the caasing. Exhaust gases entering the inlet tube are directed through the space between the inner body and the outer casing and then are discharged through the outlet tube to the exterior.

8 Claims, 3 Drawing Figures

CONCENTRIC PASS-TYPE MUFFLER CONSTRUCTION

BACKGROUND OF THE INVENTION

The conventional concentric pass-type muffler includes an outer casing having its ends enclosed by heads, and an inlet tube, which is connected to the exhaust pipe, is mounted on one head and an outlet tube is mounted in the opposite head. A generally cylindrical inner body is disposed in spaced relation within the outer casing and a baffle or flange is disposed centrally of the inner body to prevent the flow of gas directly through the inner body.

In the conventional concentric pass-type muffler, annular flanges connect the ends of the inner body to the outer casing, and the flanges are provided with openings for the passage of the exhaust gas.

The exhaust gas entering the inlet tube enters the inner body and is defflected rearwardly by the central baffle, and then passes through the annular space between the inner body and the casing to the outlet tube for discharge to the exterior.

SUMMARY OF THE INVENTION

The present invention is directed to an improved concentric pass-type muffler which eliminates the supporting flanges which have been used in the past to connect the inner body of the outer casing. The muffler includes an outer casing having its open ends enclosed by heads, and an exhaust gas inlet tube is mounted in one of the heads, while an outlet tube is mounted coaxially in the opposite head. In accordance with the invention, an inner body, which is spaced inwardly of the outer casing, is provided with a complex cross-sectional contour. The longitudinal center portion of the body has a generally circular cross sectional configuration, and a closed baffle or flange is mounted within the central portion to prevent the gas from passing directly through the inner body.

The upstream end of the body has a generally oval configuration with the major diameter of the upstream end being welded or otherwise secured to the inner surface of the casing. The downstream end of the body is also provided with a generally oval configuration with the major diameter of the downstream end being displaced 90° from that of the upstream end and being welded to the inner surface of the casing.

The exhaust gas entering the inlet tube is deflected by the flange or baffle in the inner body and will flow through the space between the inner body and the casing for discharge through the outlet tube to the exterior.

With the construction of the invention, the inner body itself is welded to the inner casing, thereby eliminating the need for annular flanges as have been used in the past to connect the inner body to the outer casing. This results in a substantial cost reduction without adversely effecting the accoustical characteristics of the muffler.

By eliminating the supporting flanges that have been used in the past, the cross-sectional area between the inner body and the outer casing can be reduced. This permits the use of a smaller diameter casing or alternately, a larger diameter inner body can be used in the outer casing.

As the major diameters of the upstream and downstream ends of the inner body are preferably displaced 90°, the exhaust gas travelling within the space between the inner body and the outer casing is forced either to rotate or to divide and this is believed to increase the attenuation of the sound energy.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
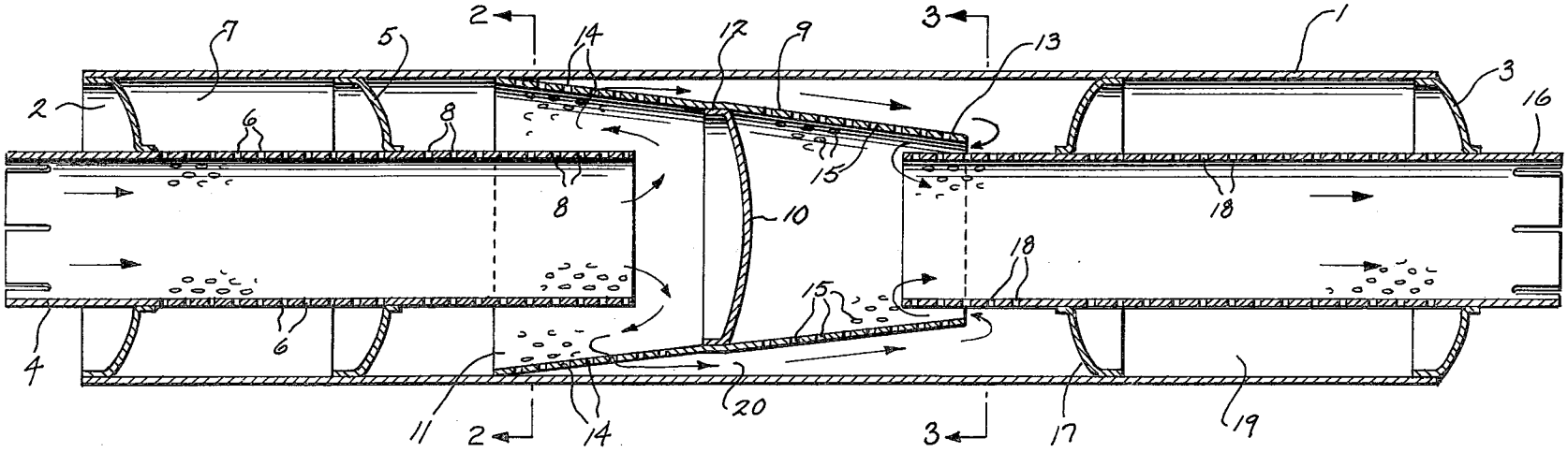
FIG. 1 is a longitudinal section of the muffler construction of the invention.
Figure 2:
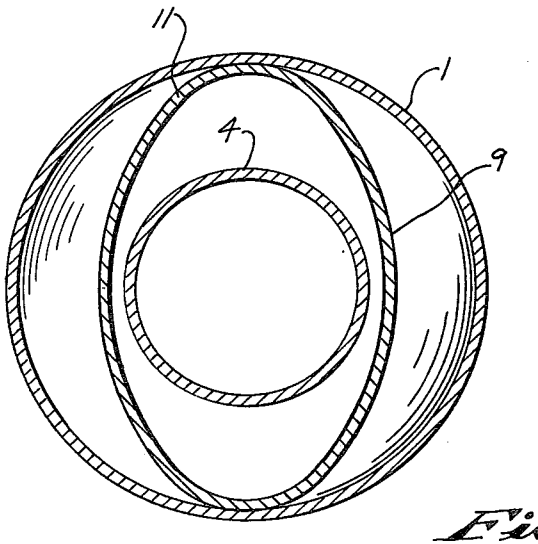
FIG. 2 is a section taken along line 2—2 of FIG. 1.

The drawings illustrate a concentric pass-type exhaust muffler comprising a generally cylindrical outer casing 1 and the ends of the casing are closed off by heads 2 and 3 which are welded to the inner surface of the casing.

Exhaust pipe 4, which is adapted to receive exhaust gases from an internal combustion engine, is secured within aligned openings in the head 2 and a baffle 5, which is welded to the inner surface of the casing 1 and is spaced downstream from the head 2. Perforations 6 are located within the portion of the exhaust pipe 4 disposed between the head 2 and baffle 5 and the perforations provide communication between the interior of the exhaust pipe 4 and the closed resonating chamber 7.

The downstream end of the exhaust pipe 4 is also provided with a series of perforations 8.

In accordance with the invention, an inner body 9 is secured centrally of the length of the casing 1 and the downstream end of the exhaust pipe 4 projects into the upstream end of the inner body 9. The central portion of the inner body 9 is closed off by a baffle 10 having a peripheral flange which is welded to the inner surface of the inner body so that the exhaust gas cannot flow directly through the inner body.

The upstream end 11 of the inner body 9 is formed with a generally oval configuration having a major axis and a minor axis. The major axis of the upstream end 11 is secured by welding to the inner surface of the casing 1, while the minor axis of upstream end 11 is spaced inwardly from the casing to provide a passage for the flow of exhaust gas.

Figure 3:
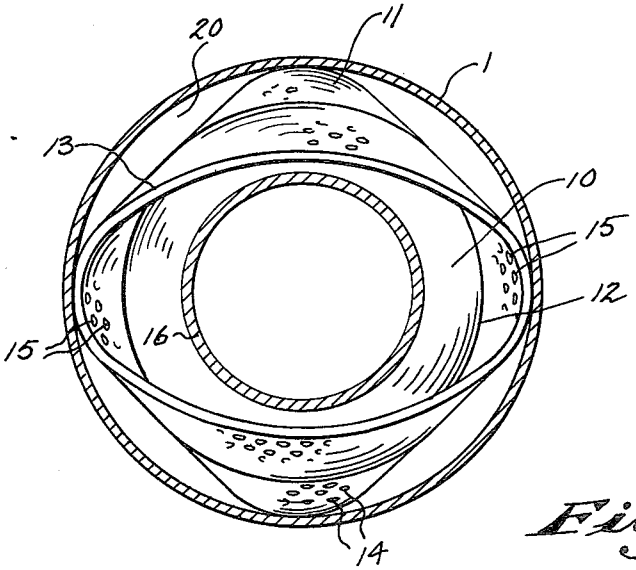
FIG. 3 is a section taken along line 3—3 of FIG. 1.

As illustrated in FIG. 3, the central portion 12 of inner body 9, whithin which the baffle or flange 10 is secured, has a generally circular configuration, while the downstream end 13 of body 9 has an oval configuration having a major axis welded to the inner surface of the casing 1 and a minor axis spaced inwardly from the casing to provide a passage for the flow of exhaust gases. The major axis of the upstream end 11 of the body 9 is displaced circumferentially from the major axis of the downstream end 13 and preferably the major axes are displaced 90°.

Both the upstream end portion and the downstream end portion of the inner body can be provided with a plurality of perforations, indicated by 14 and 15 respectively.

The exhaust gas is discharged from the muffler through an outlet pipe 16 which is welded centrally within aligned openings in head 3 and a flange or baffle 17 which is secured to the inner surface of casing 1 and spaced upstream from head 3.

Perforations 18 can be formed in the outlet pipe 16 to establish communication between the pipe 16 and the resonating chamber 19 which is located between the flange 17 and the end head 3.

Operation

The exhaust gases enter the exhaust pipe 4, and a portion of the sound energy will pass through the perforations 6 into the resonating chamber 7 and be deflected back into the exhaust tube, thereby causing an attenuation of the sound energy.

On discharge from the downstream end of the exhaust pipe 4, the exhaust gases will strike the baffle 10 and are deflected in an upstream direction, with the major portion of the sound energy being deflected by baffle 5 and entering the peripheral passage 20 between the minor axis of the upstream end 11 and the outer casing, while a minor portion of the sound energy will pass through the perforations into the peripheral passage.

The sound energy will be discharged from the passage 20 through the clearance between the minor axis of the downstream end 13 and the casing. As the major axis of the downstream end 13 is displaced 90° from that of the upstream end 11 of the body, the gases will be forced to rotate or swirl as they move through the passage 20 and this swirling action is believed to cause a further attenuation of the sound energy. Baffle 17 serves to deflect the exhaust gas and sound energy upstream into the downstream end 13 of the body where they are again deflected downstream by baffle 17 and then pass through the outlet tube 16 to the exterior.

The inner body, having oval ends which are displaced 90° from each other, enables the inner body to be attached directly to the outer casing without the use of annular flanges or other auxilliary connecting members as used in the past. By eliminating the flanges, the construction is simplified and the cost of fabrication is correspondingly reduced.

By eliminating the support flanges that are normally used in a pass-type muffler, the cross sectional area between the casing and the inner body can be reduced. This permits the use of a smaller diameter casing, or alternately, a larger diameter inner body for improved sound attenuation.

Various modes of carrying out the invention are contemplated as being within the scope of the following claims particularly pointing out and distinctly claiming the subject matter which is regarded as the invention.

I claim:

1. A muffler construction, a casing, inlet conduit means connected to the casing for introducing an exhaust gas to the casing, outlet conduit means connected to the casing for discharging the gas from the casing, an inner body disposed within the casing and having an upstream end communicating with the inlet conduit means and having a downstream end communicating with the outlet conduit means, baffle means disposed between the ends of the inner body, each end of said body having a generally oval cross-sectional configuration with a major axis and a minor axis, the portions of said body that define said major axes being secured to the casing and the portions of said body that define said minor axes being spaced from the casing to provide a passage for the flow of exhaust gas, the major axis of the upstream end of the body being displaced circumferentially from the major axis of the downstream end of the body.

2. The muffler construction of claim 1, wherein the major axis of the upstream end of the body is displaced 90° from the major axis of the downstream end of the body.

3. The muffler construction of claim 1, wherein the central portion of the length of the body has a generally circular cross sectional configuration, said baffle means being secured within said central portion.

4. The muffler construction of claim 3, wherein said baffle means is a closed structure to prevent flow of said gas directly through said body.

5. A muffler construction, comprising a generally cylindrical closed casing, inlet conduit means connected to the casing for introducing an exhaust gas to the casing, outlet conduit means connected to the casing for discharging the gas from the casing, an inner body disposed within the casing and having an upstream end communicating with the inlet conduit means and having a downstream end communicating with the outlet conduit means, baffle means disposed generally centrally of the length of the inner body, each end of the body having a generally oval cross sectional configuration with a major axis and a minor axis, the portions of said body that define said major axes being secured directly to the inner surface of the casing and the portions of said body that define said minor axes being spaced from the inner surface of the casing to provide a passage for the flow of exhaust gas, the major axis of the upstream end of the body being displaced approximately 90° from the major axis of the downstream end of the body.

6. The muffler construction of claim 5, wherein the central longitudinal portion of the body between said ends has a generally circular cross sectional configuration, said baffle means being secured within said central portion, said baffle means preventing the passage of exhaust gas directly through said inner body.

7. The muffler construction of claim 5, wherein said inlet conduit means comprises an inlet tube disposed axially of said casing, the downstream end of said inlet tube projecting within the upstream end of said inner body, said outlet conduit means comprising an outlet tube disposed axially of the casing, the upstream end of said outlet tube projecting within the downstream end of said body.

8. The muffler construction of claim 1, wherein the upstream end portion of the body and the downstream end portion of the body are provided with a plurality of perforations.

* * * * *